US006494397B1

(12) United States Patent
Myklebust

(10) Patent No.: US 6,494,397 B1
(45) Date of Patent: Dec. 17, 2002

(54) REELING MECHANISM FOR COILED TUBING

(75) Inventor: Jens Myklebust, Stavanger (NO)

(73) Assignee: JM Consult AS, Stavanger (NO)

( * ) Notice: Subject to any disclaimer, the term of this patent is extended or adjusted under 35 U.S.C. 154(b) by 0 days.

(21) Appl. No.: 09/744,758

(22) PCT Filed: Jul. 14, 1999

(86) PCT No.: PCT/NO99/00236

§ 371 (c)(1),
(2), (4) Date: Mar. 22, 2001

(87) PCT Pub. No.: WO00/06868

PCT Pub. Date: Feb. 10, 2000

(30) Foreign Application Priority Data

Jul. 29, 1998 (NO) ..... 19983483

(51) Int. Cl.[7] ..... B65H 75/40; E21B 19/22

(52) U.S. Cl. ..... 242/399.1; 242/401; 242/404; 242/406; 137/355.27; 166/77.2

(58) Field of Search ..... 242/406, 401, 242/399, 399.1, 404; 166/77.2, 77.3, 384, 385; 254/380; 137/355.26, 355.27; 405/158

(56) References Cited

U.S. PATENT DOCUMENTS 4,273,469 A 6/1981 Lunde ..... 405/158
4,945,938 A * 8/1990 Ponsford et al. ..... 137/355.26
5,836,536 A * 11/1998 Bodden ..... 242/406
5,839,514 A 11/1998 Gipson ..... 166/384

FOREIGN PATENT DOCUMENTS

EP 0 302 038 2/1989

* cited by examiner

*Primary Examiner*—John M. Jillions
(74) *Attorney, Agent, or Firm*—Proskauer Rose LLP

(57) ABSTRACT

A reeling mechanism for coiled tubing, suitable for use by work in a well. The reeling mechanism comprises a reel section with coiled tubing, a reel cradle section, and means suitable for unwinding or rewinding the coiled tubing from/on the reel section when the coiled tubing is being inserted into or withdrawn from the well. The reel section with the coiled tubing has a pallet section arranged thereto and located beneath its axis of rotation. The pallet section is adapted to secure the reel section with the coiled tubing. The pallet section comprises guide elements for running along guiding parts positioned on the reel cradle section, so that the reel section with the coiled tubing and the reel cradle section may be connected in a controlled manner. The pallet section will ensure that the reel section may be transported in a stable position out to the well.

3 Claims, 4 Drawing Sheets

REELING MECHANISM FOR COILED TUBING

BACKGROUND OF THE INVENTION

The invention relates to a device for a reeling mechanism for coiled tubing suitable for use by work in a well such as a well for the recovery of petroleum, comprising a reel section with coiled tubing, a reel cradle section, and means suitable for unwinding or rewinding the coiled tubing from/on the reel section when the coiled tubing is being inserted into or withdrawn from the well.

Coiled tubing is used by various operations in the well, which are in connection with drilling or subsequent completion of the well. The tool doing the work in question is located at the leading end of the coiled tubing, and the coiled tubing which is wound on a reel for coiled tubing, is unwound from or rewound on the reel for coiled tubing depending on whether the tool is being inserted into or withdrawn from the well. As the coiled tubing has a great length, up to 7000 m, it is given that the reel for coiled tubing will have a great weight. Therefore it is common that the reel for coiled tubing may be divided into sections, so that for example the crane equipment on an offshore installation will be able to lift the reel for coiled tubing aboard. The sections that the reel for coiled tubing is divided into, normally consist of a reel section with the coiled tubing, and a reel cradle section with the equipment that effects the unwinding or rewinding of the coiled tubing from/on the reel section, so that in the course of the work the coiled tubing may be inserted into or withdrawn from the well.

Since the weight of the reel for coiled tubing with the coiled tubing is great, often more than 50 tons, the reel for coiled tubing is often divided into sections, as mentioned, so that, among other things, the reel for coiled tubing may be handled during transport to the well and be hoisted on to the respective installation by the well. Important issues that are a consequence of the division, are how

- to keep the reel section in a stable lying position during transport from the location where the coiled tubing is wound on the reel section, to the well where the coiled tubing is to be used; and
- the connection of the reel and rack sections by the well is to be carried through.

Before the transport out to the well it is common for the reel section to be secured to the means of transportation by means of various wedges and straps. Since the reel section has a great weight, and at the same time has a circular shape, the securing work is time-consuming, and it must be done with great care so that the reel section remains stable during transport.

The connection of the reel and the reel cradle sections is done by the use of a crane, so that the reel section may be connected to the reel cradle section. The reel section then hangs freely by the crane wire end, and is directed into place on the reel cradle section by personnel standing nearby during the connection. Since the reel section is hanging freely by the crane wire end, the work is both heavy and hazardous.

SUMMARY OF THE INVENTION

The main object of the invention is to provide a device for a reeling mechanism for coiled tubing, whereby the connection of the reel section and the reel cradle section may take place automatically and without any assistance from personnel nearby. Another object is to ensure that the transport out to the well may take place in a more reassuring manner, and without the use of laborious and partly unreliable solutions in which the reel section is tied to the means of transportation. This is realized by the reel section having a pallet section arranged thereto and positioned beneath the axis of rotation of the reel section, and which may be secured to the reel section. The pallet section comprises guide elements arranged to run along the guiding parts provided on the reel cradle section, so that the reel section and the reel cradle section may be connected automatically, without the use of other personnel than the person operating the crane. Moreover, the pallet section is of a nature providing stable support on the means of transportation which is to take the reel section out of the well. Other details of the invention will appear from the dependent patent claims and the following part of the description.

BRIEF DESCRIPTION OF THE DRAWINGS

With reference to the accompanying figures preferred embodiments of the invention will be explained.

DETAILED DESCRIPTION OF THE INVENTION

Figure 1:
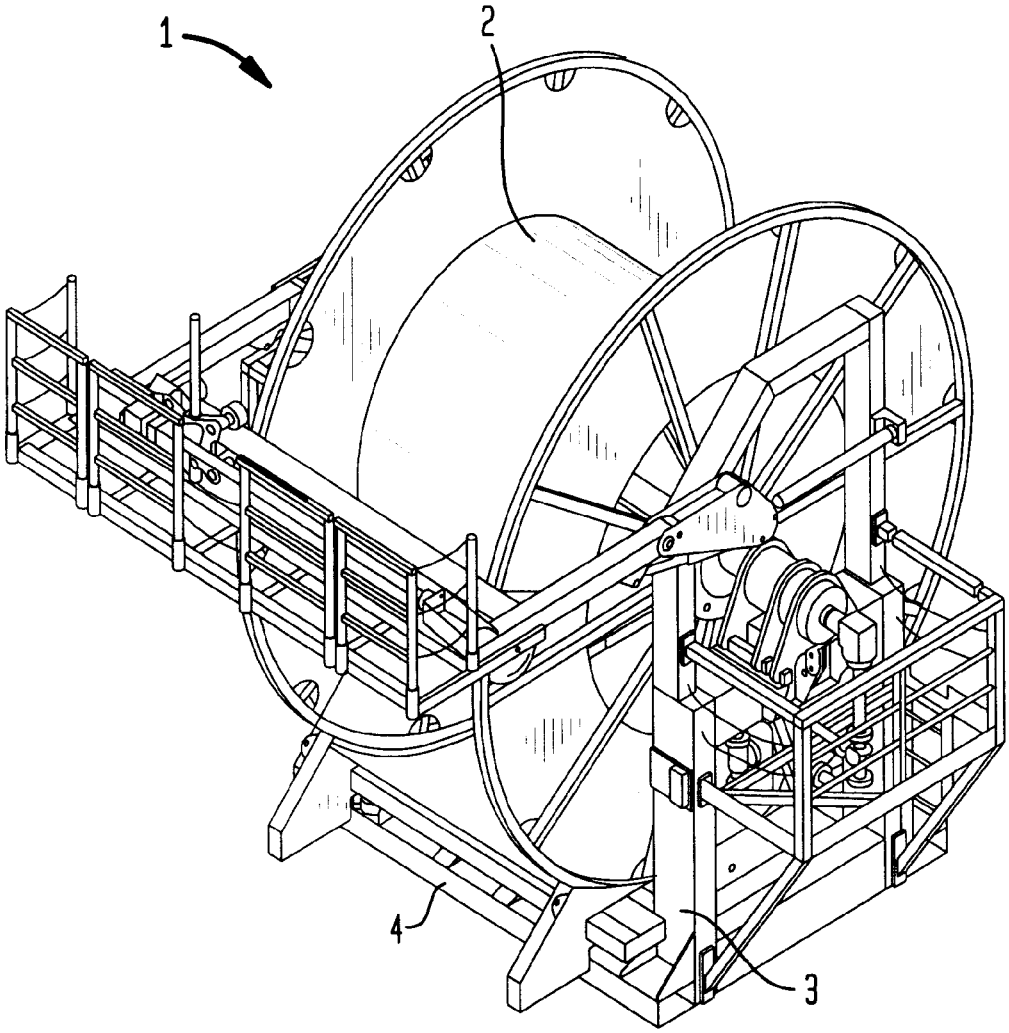
FIG. 1 shows a schematic view of the reel for coiled tubing.
Figure 2A:
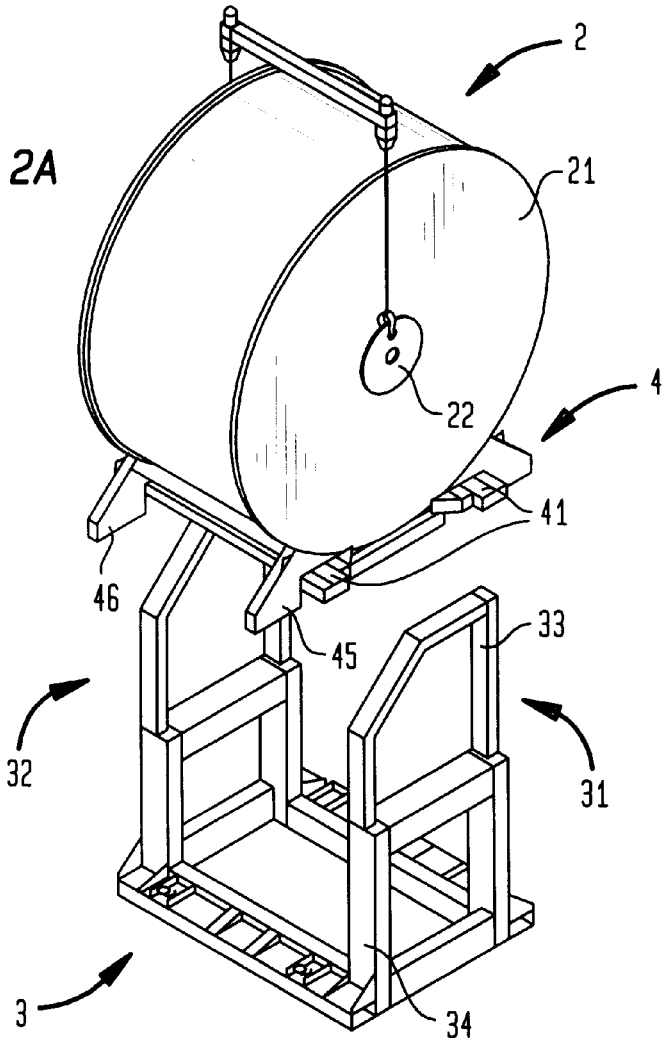
FIG. 2*a* shows a schematic view of a sectional reel for coiled tubing prior to connection of the reel section and the reel cradle section.
Figure 2B:
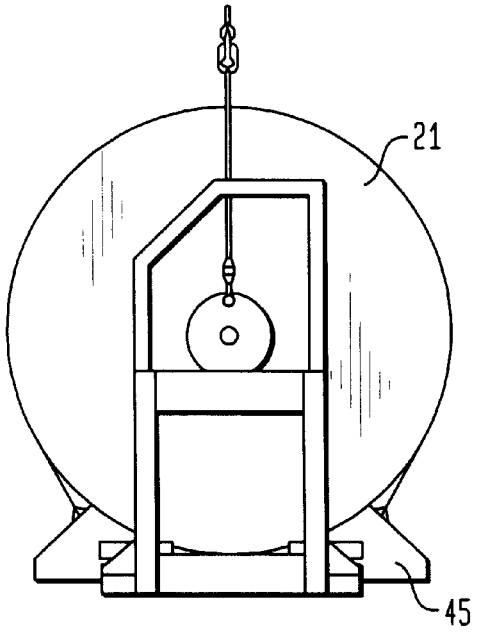
FIG. 2*b* shows a schematic view of a sectional reel for coiled tubing after the connection of the reel section and the reel cradle section has been completed.
Figure 3A:
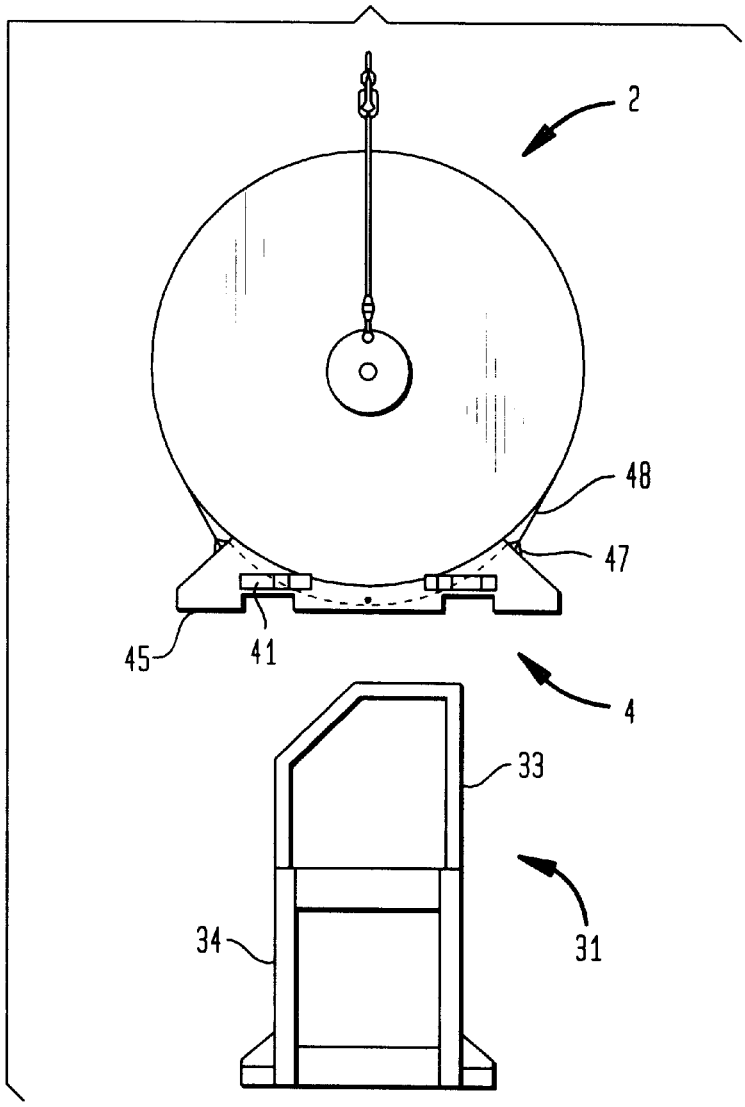
FIG. 3*a* shows the same as FIG. 2*a,* but seen vertically towards the sectional reel for coiled tubing.
Figure 3B:
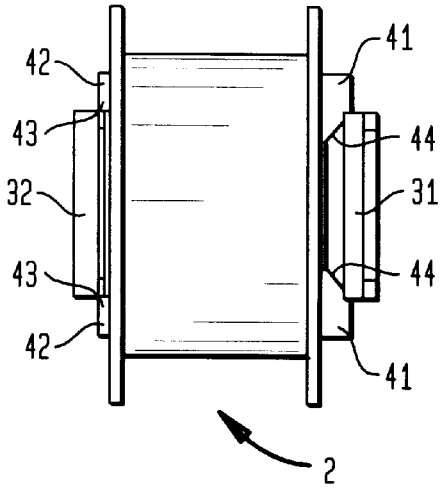
FIG. 3*b* shows the same as in FIG. 2*b* but seen in a horizontal sectional view through the assembled reel for coiled tubing.

The present reel 1 for coiled tubing consists, as is common, of a reel section 2 with coiled tubing, a reel cradle section 3, and means suitable for unwinding or rewinding the coiled tubing from/on the reel section when the coiled tubing is being inserted into or withdrawn from the well. The coiled tubing is wound on the reel section by the coiled tubing manufacturer. Further the reel section 2 has a pallet section 4 arranged thereto and positioned beneath the axis of rotation of the reel section 2 and may be secured to the reel section 2.

The pallet section comprises supports 45, 46 for the reel section 2, so that the reel section 2 may be supported in a stable position, lying on the pallet 4. The stable lying may be provided by the supports 45, 46 having a shape fit for bearing against one part each of the circular end pieces 21 of the reel section 2. The pallet section 4 comprises securing means 47, 48, so that the reel section 2 may be secured to the pallet section 4. The securing means are arranged in association with the supports 45, 46 and may be formed by for example hooks 47 near each end of the supports 45, 46, and straps 48 spanning between each set of hooks 47 of the respective support 45, 46. The underside of the pallet section 4 is formed so that the pallet section with the secured reel section 2 may stand stably on the means of transportation used for the transport out to the well. Thereby the pallet section can be secured in a simple manner to the means of transportation, without extensive use of wedges and straps.

Further, the underside of the pallet section 4 is provided with longitudinal recesses adapted to corresponding parts of the lower end of the reel cradle section 3, so that the pallet section 4 may stand stably on the reel cradle section 3. For the collection of impurities washed off the coiled tubing, the pallet section 4 is equipped with a collecting element (not shown), for example in the form of a recess, with an outlet arranged thereto, so that said impurities may be taken care of in a controlled manner.

To enable automatic connection of the reel section 2 and the reel cradle section 3, and without the assistance of personnel for the reeling mechanism 1 for coiled tubing, the pallet section 4 comprises guide elements 41, 42 arranged to run along guiding parts 31, 32, placed on the reel cradle section 3, during the connection. The guide elements 41, 42 extend from the side edges of the pallet section 4 facing the reel cradle section 3. Thereby the guide elements 41, 42 on the respective side edge of the pallet section 4 will form a gap suitable for sliding along a guiding part 31, 32 each. To ensure good cooperation with the guiding parts 31, 32 the guide elements 42 on one side edge of the pallet section 4 is configured so that the terminal edges 43 facing the guiding part 32, extend essentially perpendicular to the side edge of the pallet part 4. Further, the guide elements 41 of the opposite side edge of the pallet section 4 are formed so that the terminal edges 44 facing the guiding part 31, extend in an outward slope in a portion by the side edge, and substantially perpendicular to the side edge of the pallet section 4 in a following portion. The guiding parts 31, 32 are formed of two guiding part posts 33, 34 which extend essentially vertically and which are placed on either side of the axis of rotation of the reel 1 for coiled tubing. To avoid problem when the guide elements 41, 42 are to be advanced towards the guiding parts 31, 32, the upper portion of one guiding part post 34 has an extent sloping inwards towards the opposite guiding part post 33. Likewise, the upper portion of one guiding part 32 is formed with a curtailed width in the portion facing the pallet section 4, so that the distance between the guiding parts 31, 32 is somewhat larger.

The device has a jack device (not shown) arranged thereto and placed between the lower part of the reel cradle section 3 and the underside of the pallet section 4. The jack device is suitable for lifting the pallet section 4 after the pallet section 4 has been brought to rest against the bottom part of the reel cradle section 3. The pallet section 4 is lifted to a height allowing rotational shafts on each side of the reel cradle section 3 to engage central openings 22 of the end pieces 21 of the reel section, so that the reel 1 for coiled tubing is made ready for use.

Figure 4A:
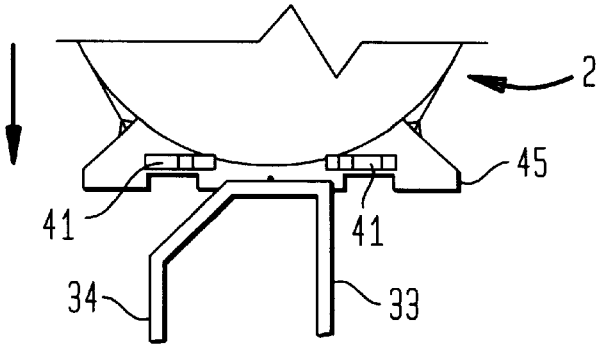
FIGS. 4*a–d* show schematic views of the sections of the reel for coiled tubing in the initial part of the connection.
Figure 4B:
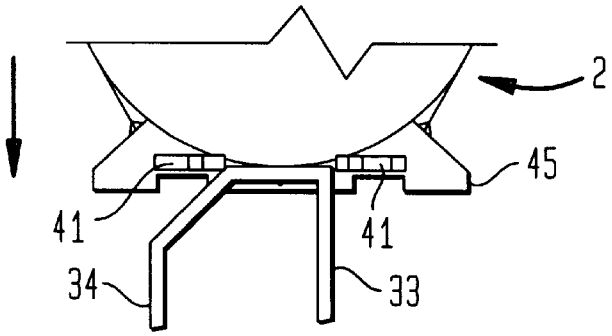
Figure 4C:
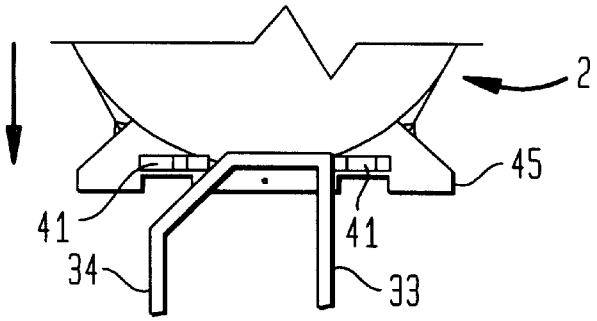
Figure 4D:
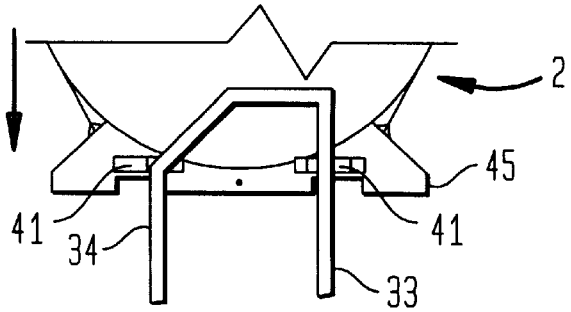

FIGS. 4*a–d* outline how the terminal edges 44 of the respective guide element 41 bear against the guiding part posts 33, 34. During the hoisting aboard, the reel section 2 hangs on a yoke, and is brought in towards the reel cradle section 3 so that the guide elements 41, 42 come to bear against the guiding parts 31, 32. The sloping portion of the terminal edges 41 will run downwards along the upper portion of the guiding part post 33, and the sloping part of the guiding part post 34. Said sloping portion of the guide element 41 will at the same time ensure that the pallet section 4 is displaced sideways towards the guiding part 32. Then the outer portion of the terminal edges 44 of the guide elements 41 come to bear against the vertical parts of the guiding part posts 33, 34. As mentioned, the opposite guiding part 32 has a curtailed width in an upper portion. Thereby the upper portion of the guiding part 32 will first and foremost have a correcting effect during the initial part of the connection, when the pallet part 4 is being centred between the guiding parts 31, 32, while the terminal edges 43 of the pallet section orly come to rest fully against the guiding part posts 33, 34 in a lower portion of the guiding part 32.

What is claimed is:

1. A reeling mechanism for coiled tubing comprising:

a reel section with coiled tubing, a reel cradle section, and means for unwinding or rewinding the coiled tubing from or onto the reel section when the coiled tubing is inserted into or withdrawn from the well, wherein the reel section with the coiled tubing has a pallet section arranged thereon and located beneath an axis of rotation of the reel section with the coiled tubing, and which is adapted to secure the reel section with the coiled tubing, and wherein the pallet section comprises guide elements for running along guiding parts positioned on the reel cradle section, so that the reel section with the coiled tubing and the reel cradle section may be connected automatically and in a controlled manner, and wherein the guide elements extend from first and second side edges of the pallet section facing the reel cradle section, so that the guide elements of each respective side edge form a gap for each guiding part, and wherein the guide elements on the first side edge of the pallet section are formed so that terminal edges facing a first of the guiding parts extend essentially perpendicular to the first side edge of the pallet section, and wherein the guide elements of the second side edge of the pallet section are formed so that first and second terminal edges facing a second of the guiding parts are sloping outwards in a portion by the first and second side edges and essentially perpendicular to the first and second side edges of the pallet section in a following portion.

2. A reeling mechanism for coiled tubing comprising:

a reel section with coiled tubing, a reel cradle section, and means for unwinding or rewinding the coiled tubing from or onto the reel section when the coiled tubing is inserted into or withdrawn from the well, wherein the reel section with the coiled tubing has a pallet section arranged thereon and located beneath an axis of rotation of the reel section with the coiled tubing, and which is adapted to secure the reel section with the coiled tubing, and wherein the pallet section comprises guide elements for running along guiding parts positioned on the reel cradle section, so that the reel section with the coiled tubing and the reel cradle section may be connected automatically and in a controlled manner, wherein each guiding part is formed of first and second guiding part posts extending essentially vertically, and wherein the guiding part posts are positioned on either side of the axis of rotation of the reel for coiled tubing, and wherein an upper portion of the first guiding part post extends in an inward slope towards the second guiding part post.

3. A reeling mechanism for coiled tubing comprising a reel section with coiled tubing, a reel cradle section, and means for unwinding or rewinding the coiled tubing from or onto the reel section when the coiled tubing is inserted into or withdrawn from the well, wherein the reel section with the coiled tubing has a pallet section arranged thereon and located beneath an axis of rotation of the reel section with the coiled tubing, and which is adapted to secure the reel section with the coiled tubing, wherein the pallet section is formed with first and second supports for the reel section with coiled tubing, the first and second supports having a shape suitable for supporting circular end pieces of the reel section, wherein securing means are arranged to the first and second supports for securing the reel section to the pallet section, and wherein the pallet section comprises guide elements for running along guiding parts positioned on the reel cradle section, so that the reel section with the coiled tubing and the reel cradle section may be connected automatically and in a controlled manner, and wherein a jack device is placed between a bottom part of the reel cradle section and the pallet section for lifting the pallet section after connection is completed.

* * * * *